US008230979B2

(12) United States Patent
Finschi et al.

(10) Patent No.: US 8,230,979 B2
(45) Date of Patent: Jul. 31, 2012

(54) TRANSPORTATION METHOD ASSOCIATING AN ACCESS STORY WITH A DESTINATION STORY

(75) Inventors: Lukas Finschi, Lucerne (CH); Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 587 days.

(21) Appl. No.: 11/792,215

(22) PCT Filed: Nov. 28, 2005

(86) PCT No.: PCT/CH2005/000705

§ 371 (c)(1),
(2), (4) Date: Jun. 26, 2007

(87) PCT Pub. No.: WO2006/058445

PCT Pub. Date: Jun. 8, 2006

(65) Prior Publication Data

US 2008/0128219 A1 Jun. 5, 2008

(30) Foreign Application Priority Data

Dec. 1, 2004 (EP) ..... 04106222

(51) Int. Cl.
*B66B 1/18* (2006.01)

(52) U.S. Cl. ..... 187/387; 187/902; 187/388

(58) Field of Classification Search ..... 187/380–388, 187/391–396, 902, 249
See application file for complete search history.

(56) References Cited

U.S. PATENT DOCUMENTS

| | | | | |
|---|---|---|---|---|
| 3,385,402 | A | 5/1968 | Burgy et al. | |
| 4,149,614 | A | 4/1979 | Mandel et al. | |
| 4,662,479 | A | 5/1987 | Tsuji et al. | |
| 4,691,808 | A * | 9/1987 | Nowak et al. | 187/385 |
| 4,836,336 | A * | 6/1989 | Schroder | 187/384 |
| 4,895,223 | A | 1/1990 | Ekholm et al. | |
| 5,086,883 | A * | 2/1992 | Schroder | 187/258 |
| 5,092,430 | A * | 3/1992 | Goto et al. | 187/384 |
| 5,382,761 | A * | 1/1995 | Amano | 187/383 |
| 5,490,580 | A | 2/1996 | Powell et al. | |
| 5,644,110 | A * | 7/1997 | Bahjat et al. | 187/385 |
| 5,689,094 | A | 11/1997 | Friedli et al. | |
| 5,719,360 | A * | 2/1998 | Davis et al. | 187/383 |
| 5,786,550 | A | 7/1998 | Thangavelu | |
| 5,841,084 | A | 11/1998 | Thangavelu | |
| 5,861,587 | A * | 1/1999 | Powell et al. | 187/382 |
| 5,984,051 | A | 11/1999 | Morgan et al. | |
| 6,065,570 | A | 5/2000 | Friedli et al. | |
| 6,109,396 | A | 8/2000 | Sirag et al. | |
| 6,202,799 | B1 * | 3/2001 | Drop | 187/388 |

(Continued)

FOREIGN PATENT DOCUMENTS

| | | |
|---|---|---|
| EP | 1418147 | 5/2004 |

(Continued)

*Primary Examiner* — Jonathan Salata

(74) *Attorney, Agent, or Firm* — Wolff & Samson, PC

(57) ABSTRACT

The invention relates to a method and an arrangement for transporting people in a building using an elevator installation (10) having at least one elevator cage (11). The elevator cage (11) is entered by people on at least one first or one second access floor (S1, S2). In order to increase the transport efficiency, at least one target floor (S3, S4, S5, S6, S7) is associated with each access floor (S1, S2) in a fixed manner, in such a way that the elevator cage (11) travels from the first access floor (S1) to the associated first target floor (S4, S5) and from the second access floor (S2) to the associated second target floor (S5, S6, S7).

19 Claims, 4 Drawing Sheets

U.S. PATENT DOCUMENTS

| | | | | |
|---|---|---|---|---|
| 6,209,685 | B1 | 4/2001 | Zaharia et al. | |
| 6,315,083 | B1 * | 11/2001 | Schuster et al. | 187/391 |
| 6,382,363 | B1 * | 5/2002 | Friedli | 187/384 |
| 6,397,976 | B1 | 6/2002 | Hale et al. | |
| 6,425,460 | B2 * | 7/2002 | Schuster | 187/247 |
| 6,801,792 | B1 * | 10/2004 | Schuster et al. | 455/566 |
| 6,978,863 | B2 * | 12/2005 | Hikita | 187/382 |
| 7,108,106 | B2 * | 9/2006 | Kostka | 187/391 |
| 7,165,655 | B2 | 1/2007 | Cook et al. | |
| 7,319,968 | B2 * | 1/2008 | Friedli et al. | 705/1 |
| 7,353,915 | B2 * | 4/2008 | Zaharia et al. | 187/388 |
| 7,377,364 | B2 | 5/2008 | Tyni et al. | |
| 7,581,622 | B2 | 9/2009 | Amano | |
| 7,650,966 | B2 * | 1/2010 | Sansevero et al. | 187/249 |
| 7,841,450 | B2 * | 11/2010 | Smith et al. | 187/249 |
| 8,020,672 | B2 | 9/2011 | Lin et al. | |
| 2007/0272495 | A1 | 11/2007 | Makela et al. | |
| 2008/0169159 | A1 | 7/2008 | Finschi et al. | |
| 2009/0294221 | A1 | 12/2009 | Bahjat et al. | |

FOREIGN PATENT DOCUMENTS

| | | |
|---|---|---|
| GB | 2313453 | 11/1997 |
| JP | 507337 | 3/1975 |
| JP | 03166177 | 7/1991 |
| JP | 11222372 | 8/1999 |
| JP | 2004250191 | 9/2004 |

* cited by examiner

TRANSPORTATION METHOD ASSOCIATING AN ACCESS STORY WITH A DESTINATION STORY

This is a U.S. national stage of application No. PCT/CH2005/000705, filed on Nov. 28, 2005. Priority is claimed on that application and on the following application:
Country: Europe, Application No.: EP 04106222.5 filed: Dec. 1, 2004.

BACKGROUND OF THE INVENTION

The invention relates to a method of transporting persons in a building by means of an elevator installation, which comprises at least one elevator cage, wherein the elevator cage is entered by persons at least one first or at a second access story. The invention further relates to an arrangement for transporting persons in a building with at least one elevator installation, which comprises at least one elevator cage, wherein at least two access stories are provided.

Elevator installations for transporting persons are used in modern high-rise buildings. The persons are usually transported at similar starting times by an elevator installation to the respective work or office stories or at similar end times back to the access stories. Due to the high loading of the lift installations at these times use is made of complicated elevator control programs in order to increase effectiveness in the transport of persons. For example, a destination call control is used by way of which a passenger inputs his or her travel destination by means of an input device. An elevator control then assigns a elevator cage to the appropriate person on the basis of the desired destination story. It is thus achieved that persons having common destination stories are concentrated in the elevator cage so that the travel time of the elevator cage is not prolonged by numerous intermediate stops.

A control device for controlling an elevator installation with a multiple cage is known from EP 1 418 147 A 1. The multiple cage has several cage decks which are simultaneously accessible at a main stopping point by way of several main stopping planes. Two stories of a building can be simultaneously served by the multiple cage with one stop. A call registration device by means of which a passenger can input his or her desired destination story is provided at the main stopping point. In order to enable more rapid filling of the building and to minimise the number of intermediate stops of the multiple cage there is provided a computing unit constructed for the purpose of ascertaining, on the basis of the destination call input of the passenger at the main stopping point and on the basis of already allocated and/or placed travel requests, which cage deck of the multiple cage is to be assigned to the passenger at the main stopping point. The passenger is thus assigned to a level, which corresponds with his or her destination call input, enabling effective transport of persons by means of the multiple cage. After input of the destination call the passenger must then go to the corresponding level in order to enter the multiple cage at the appropriate level.

The assignment of persons to multiple cages by means of a destination call control and even the assignment of persons to single elevator cages by means of a destination call control requires a complex control. Notwithstanding this destination call control, delays in the transport of persons occur particularly at peak times since, for example, persons who have not input a destination call board elevator cages.

Against this background the object of the present invention arises as indication of a method and an arrangement for transport of persons in buildings in which the number of intermediate stops at stories of a building is minimised and shorter travel times are achievable.

The invention is based on the concept that modern office buildings usually have several access stories. If several access stories by way of which the building is opened up are present, the performance capability of the elevator installation can be increased if at least one destination story is allocated to each access story. In the case of the design according to the invention the elevator cage travels from a first access story to at least one fixedly allocated first destination story. Equally, an elevator cage travels from a second access story to at least one fixedly allocated second destination story, which in principle differs from the first destination story. According to the invention persons can be so guided to the access stories so that they are transported from an access story to the allocated destination story without an intermediate stop. Through guidance of persons to the respective correct access stories, persons with the same destination story enter the elevator cage at the same access story. From there the elevator cage travels directly to the corresponding destination story.

By contrast to the assignment, which is known from the state of the art, of elevator cages by means of destination call control here there takes place guidance of persons to access stories with fixed destination stories.

Thus it is ensured that, for example, the employees of a relevant company who daily travel to the same destination story always enter the elevator cage at the same access story and travel from there to their destination story. Persons of another company based in a different story use another access story from which an elevator cage travels to the destination story at which the other company has its offices. Transport in the elevator cages to further stories takes place without intermediate stops.

In a simple embodiment the invention can be performed already with an elevator cage which travels, in particular at appropriate times, from a first access story to a first fixedly allocated destination story and from a second access story to a second fixedly allocated destination story, wherein the first and second destination stories are different from one another. Thus, persons with the same destination stories are guided to the same access stories whereby travel times of the elevator cages are significantly reduced.

An efficient transport of persons is thereby made possible particularly at peak times. Flows of persons can be guided by the method according to the invention, wherein the several access stories are effectively utilised. There is avoidance of the situation that all persons who would like to be transported in this building wait for an elevator cage at a single access story and have to be assigned the elevator cages depending on destination call inputs. In addition, there is avoidance of the situation there persons not only of the first company, but also of the second company board the elevator cages at the first and second access story and travel from there to their destination stories. In this case the elevator cage would have to stop not only at the first, but also at the second access story, and also at the first and second destination story. It is more effective, particularly if two elevator cages are provided for transportation, to let an elevator cage travel from the first access story directly to the first destination story and the second elevator cage to travel from the second access story to the second destination story. The sole precondition for effective transportation is in this connection is that persons board the elevator cages at the correct access stories.

Advantageous embodiments of the invention can be inferred from the subclaims.

In a special refinement of the invention it is possible that a first group of destination stories is fixedly allocated to a first access story and a second group of destination stories is fixedly allocated to a second access story. In that case the first and second groups can essentially comprise different destination stories. However, it is also possible that the first and second groups of destination stories go to a common story, for example a changeover story. A reduction in the possible intermediate stops is thus achieved, whereby the travel time is minimised. Allocation of groups of destination stories to one access story is useful particularly when companies have offices in several stories. Thus, persons have in this access story only the possibility of selecting between the destination stories of the group to which the company and thus this access story are allocated.

It is particularly advantageous if the assignment of persons to the first or second access story is undertaken in accordance with the respective destination stories of persons by a building control unit independently of an elevator control.

For example, indicator boards can be used which illustrate the fixed allocation of destination stories to the respective access stories. Persons who want a first company can read off the respective access story and go there. This is particularly advantageous if the allocation of the destination stories to the access stories is variable so that employees of companies have to reorientate themselves on a daily basis with regard to from which access story an elevator cage travels to their destination story. In the case of nonvariable allocation of the destination stories to the access stories the assignment or guidance of persons to the access stories can be effected by a permanent inscription in the building.

In a special embodiment of the invention an access authorisation to an access story is checked by the building control unit. It can thus be ensured that persons without access authorisation do not get to the respective access story. The building control unit can allocate and indicate the respective access story to the persons in dependence on their access authorisation. In this connection the terms "story" and "access story" have a general meaning and signify an access region or a lobby located at the side of a door.

Checking of the access authorisation can be undertaken by means of, for example, a wireless transmission of an access code which is stored on an identification card. Persons carry the identification cards. The access code on entry into the building is interrogated by the building control unit either wirelessly or on a contact basis through introduction into a reader. The access authorisation is determined in dependence on the access code. If an access authorisation is present, a door or a barrier is opened which frees access to an access story. It is also possible to input an access code by means of an input apparatus in order to obtain access to an access story. For that purpose a person inputs his or her destination call or access code into the input apparatus, wherein there is shown on a display the respective access story from which an elevator cage travels directly to the desired destination story. It is thus possible to grant persons restricted access to public stories. On input of a non-public destination story, access is denied. If, thereagainst, the person inputs a permissible destination call for a public destination story, access is made possible to the access story from which an elevator cage travels to the public destination stories. The access authorisation can also be carried out in functional manner. Physical access is denied not by a door or a barrier, but the elevator cannot be called without authorisation. The elevator door itself in this case represents the physical barrier.

A co-ordination of the individual flows of persons can be undertaken in that the access authorisation is, for example, interrogated before the respective persons enter the access story. After determination of the access authorisation exactly the door or barrier is opened which leads to the access story to which the respective person is authorised for access.

Flows of persons can be efficiently co-ordinated by the method according to the invention so that, for example, persons who want a restaurant in the uppermost floor input the destination call 'Restaurant' on entry into the building and then there is allocated an access story from which an elevator cage travels directly to the story in which the restaurant is located. Other destination stories cannot be reached by restaurant visitors.

Beyond that it is also possible that after successful checking of the access authorisation to an access story the person having an appropriate form of access authorisation can change the destination story in the elevator cage. It is thus ensured that persons with special access authorisation (VIPs) after entry into a lift cage not only are transported to the fixedly allocated destination story, but can also go to other destination stories.

The method according to the invention can be used particularly efficiently if the lift installation has several elevator cages, wherein a first elevator cage serves the first access story and a second elevator cage serves the second access story. If beyond that still further elevator cages are arranged in the elevator installation for transport of persons it is possible that several elevator cages travel from one access story fixedly to one destination story or that there is provided an additional elevator cage for the transport of persons to other destination stories for which no fixed allocation is present.

In a preferred embodiment of the invention the destination stories are fixedly allocated to the access stories only at specific times. The fixed allocation of destination stories to the access stories is offered particularly at peak times in order to efficiently cover the increased transport requirement. Between peak times all destination stories in the building can be reached by the elevator cage.

In a preferred refinement of the invention it is possible to use the fixed allocation of destination stories to the access stories in combination with a destination call control. This variant offers itself particularly when several elevator cages are present which serve a group of fixedly allocated destination stories.

In the case of an arrangement according to the invention for the transport of persons in a building with an elevator installation the elevator installation comprises at least one elevator cage, wherein at least two access stories are provided and at least one respective destination story is allocated to each of the destination stories.

In an advantageous embodiment it is provided that a building control unit undertakes the assignment or guidance of persons to access stories in accordance with their destination stories, wherein the building control unit is advantageously coupled with access terminals. The access terminals can be constructed as part of the building control unit. The access terminals receive an access code in wire-free manner, on a contact basis or by user input. An access authorisation is determined from this access code directly in the access terminal or in the building control unit and an access story is displayed to the person or access is granted to the corresponding access story.

In a further advantageous embodiment there is provided at least one access barrier in the form of a door or barrier which is opened or closed in dependence on the access authorisation.

In addition, an indicating device for indication of an association of the destination stories to the access stories is preferably provided. The indicating device can be constructed in the form of a display in order to indicate a variable allocation of access stories to destination stories. The indicating device can, however, also be constructed as a simple information panel in the case of a fixed allocation.

In a special refinement of the invention elevator cages with several part cages separate from one another are used in order to achieve efficient transport of persons. For this purpose the elevator cage is, for example, divided vertically or horizontally. In the case of a vertical separation of the elevator cage the elevator cage can be entered from two sides, wherein the part cage able to be entered from one side of the access story travels to a specific destination story and the part cage able to be entered from the other side of the access story travels to the respective other side of the destination story, wherein the respective sides of the access and destination stories are separate from one another. Similarly, it is possible to divide an elevator cage horizontally into an upper and a lower part cage. Thus, persons who enter the lower part cage by way of a lower access story are transported to a lower destination story. Persons who enter the upper part cage at an upper access story are transported by the same elevator cage to a destination story arranged exactly one story above the lower destination story. It is thus ensured that persons are transported without disturbance by one another.

The invention is explained in more detail in the following on the basis of examples of embodiment, which are illustrated in schematic manner in drawings, in which.

Figure 3:
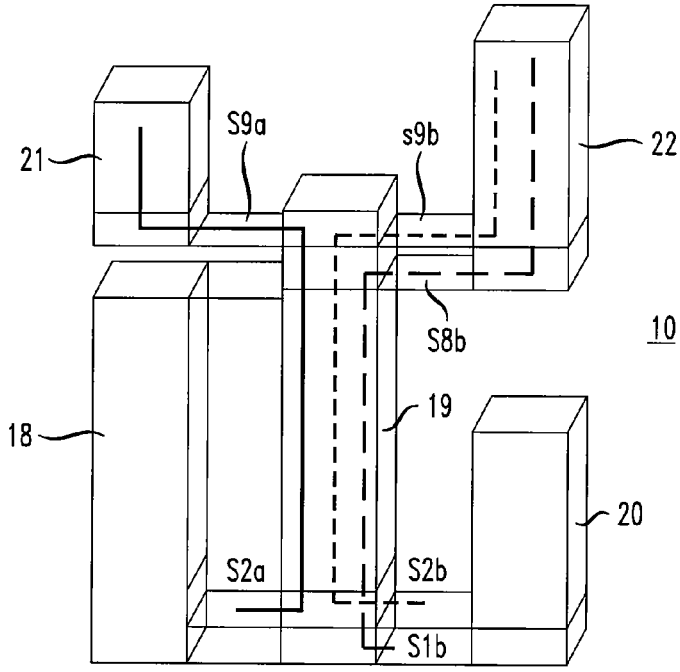
Figure 4A:
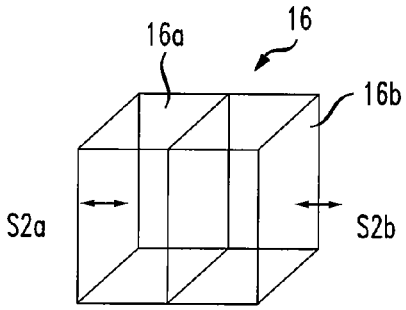
Figure 4B:
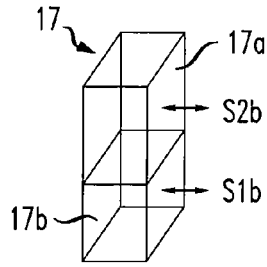
Figure 5A:
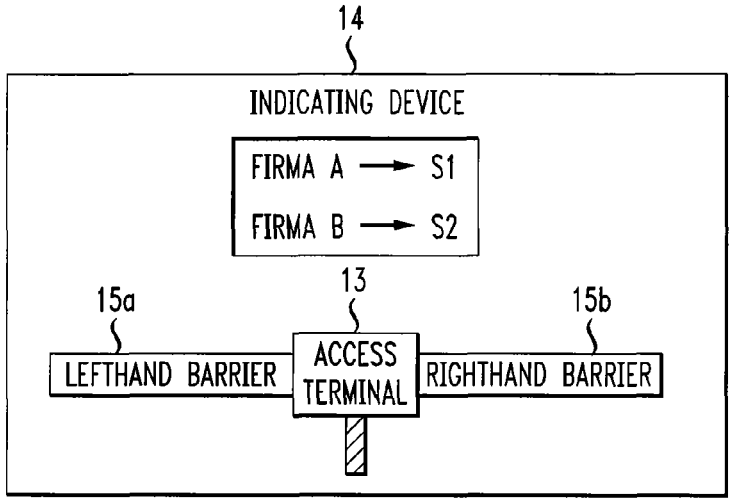
Figure 5B:
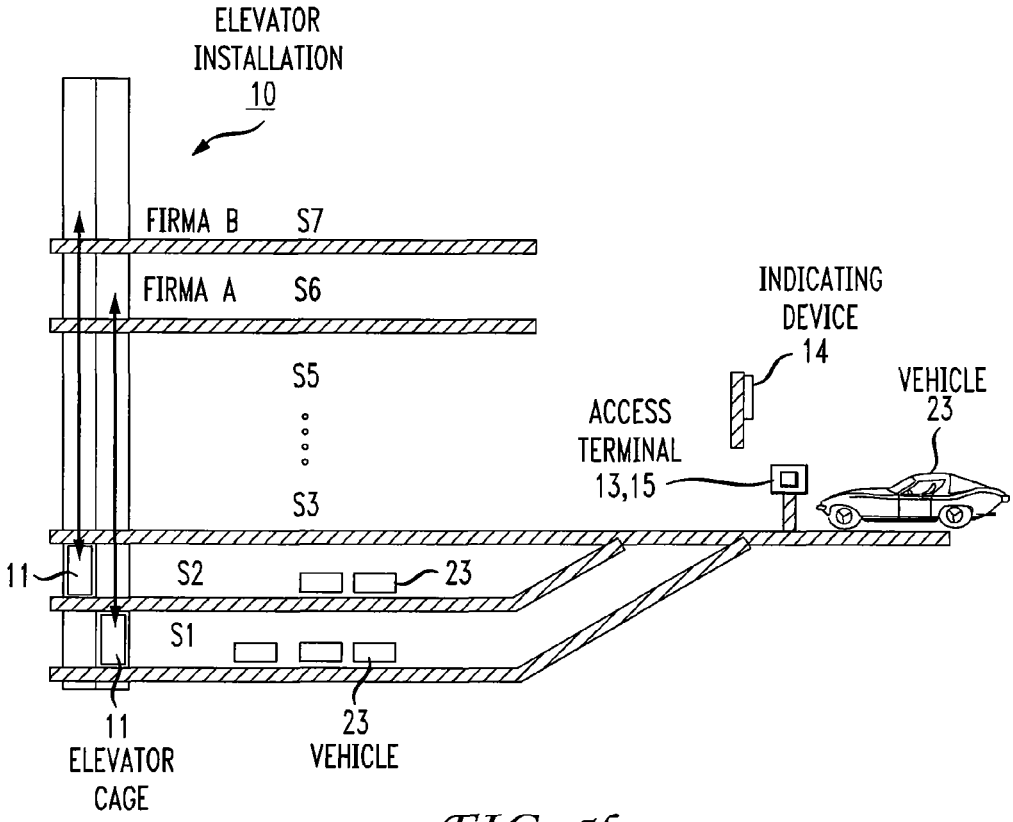

FIG. 3. shows a schematic illustration of a further alternative embodiment according to the present invention;

FIG. 4*a*. shows an elevator cage with vertical division;

FIG. 4*b*. shows an elevator cage with horizontal division;

FIG. 5*a*. shows a schematic illustration for guidance of persons and a display of access stories, according to the present invention; and FIG. 5*b*. shows a schematic illustration of an elevator installation and the guidance of persons according to the present invention.

DETAILED DESCRIPTION OF THE INVENTION

Figure 1:
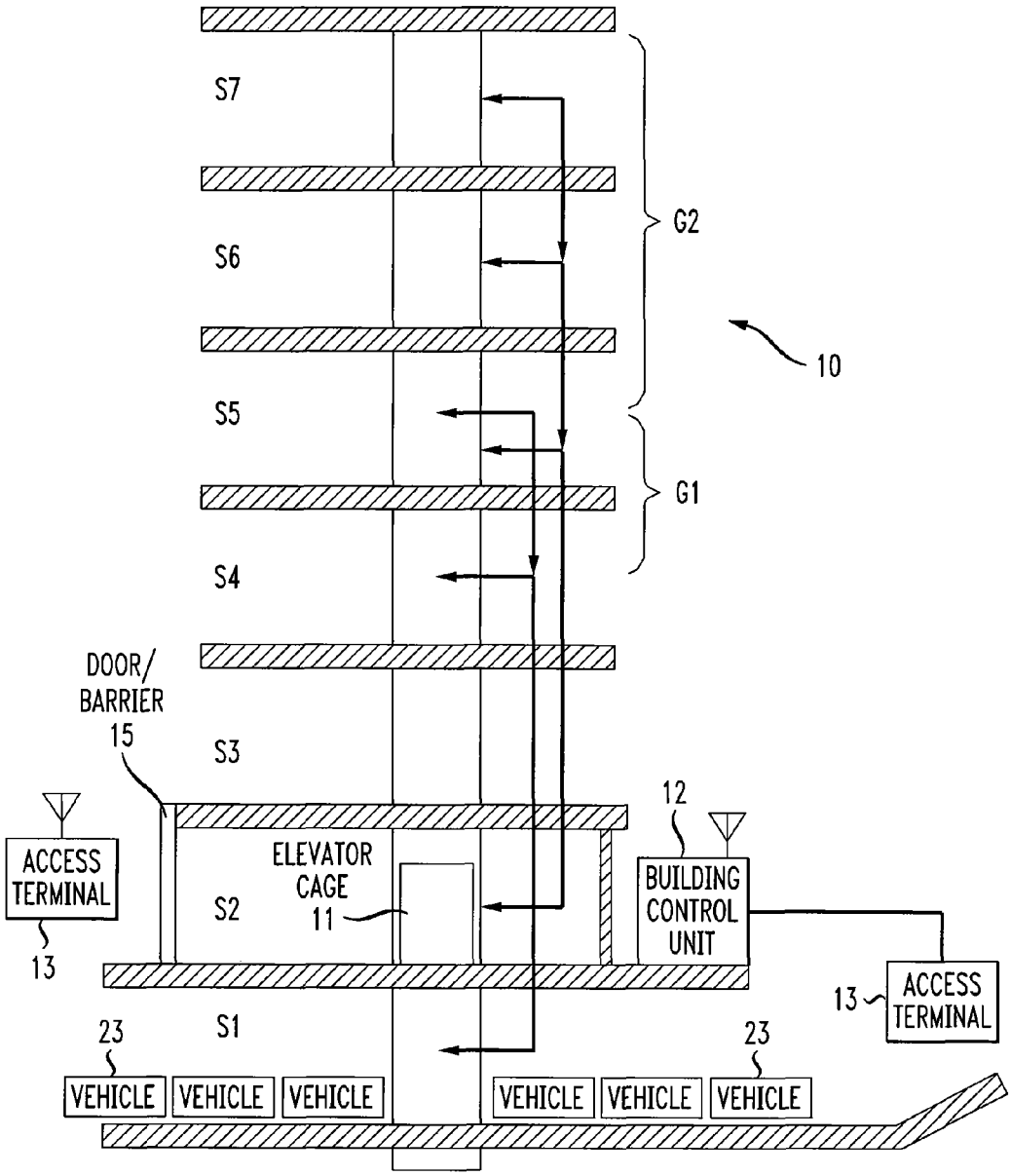
FIG. 1 shows a schematic illustration of an elevator installation according to the present invention.

A schematic illustration of a building with An elevator installation 10 and with seven stories is shown in FIG. 1. Of those, the stories S1 and S2 are developed as access stories and the stories S4 to S7 as destination stories. An elevator cage 11 is moved in the elevator installation 10 in order to transport persons from the respective access stories S1 and S2 to a destination story S4, S5, S6 or S7. The access story S1 is an underground garage to which vehicles 23 of the persons go after they have identified their access authorisation at an access terminal 13. Persons boarding the elevator cage 11 in the underground garage or the access story S1 are transported either to the destination story S4 or to the destination story S5. Persons who enter the elevator cage 11 at the access story S2 are transported to the destination story S5, S6 or S7. Access to the access story S2 is blocked by a door 15 which is opened only after checking of an access authorisation at an access terminal 13. The two access terminals 13 are coupled with a building control unit 12 either wirelessly via the indicated aerials or by way of a connecting line. A first group G1 of destination stories, which comprises the destination stories S4 and S5, can be reached from the first access story S1. A group G2 with the destination stories S5, S6 and S7 is allocated to the second access story S2.

Figure 2:
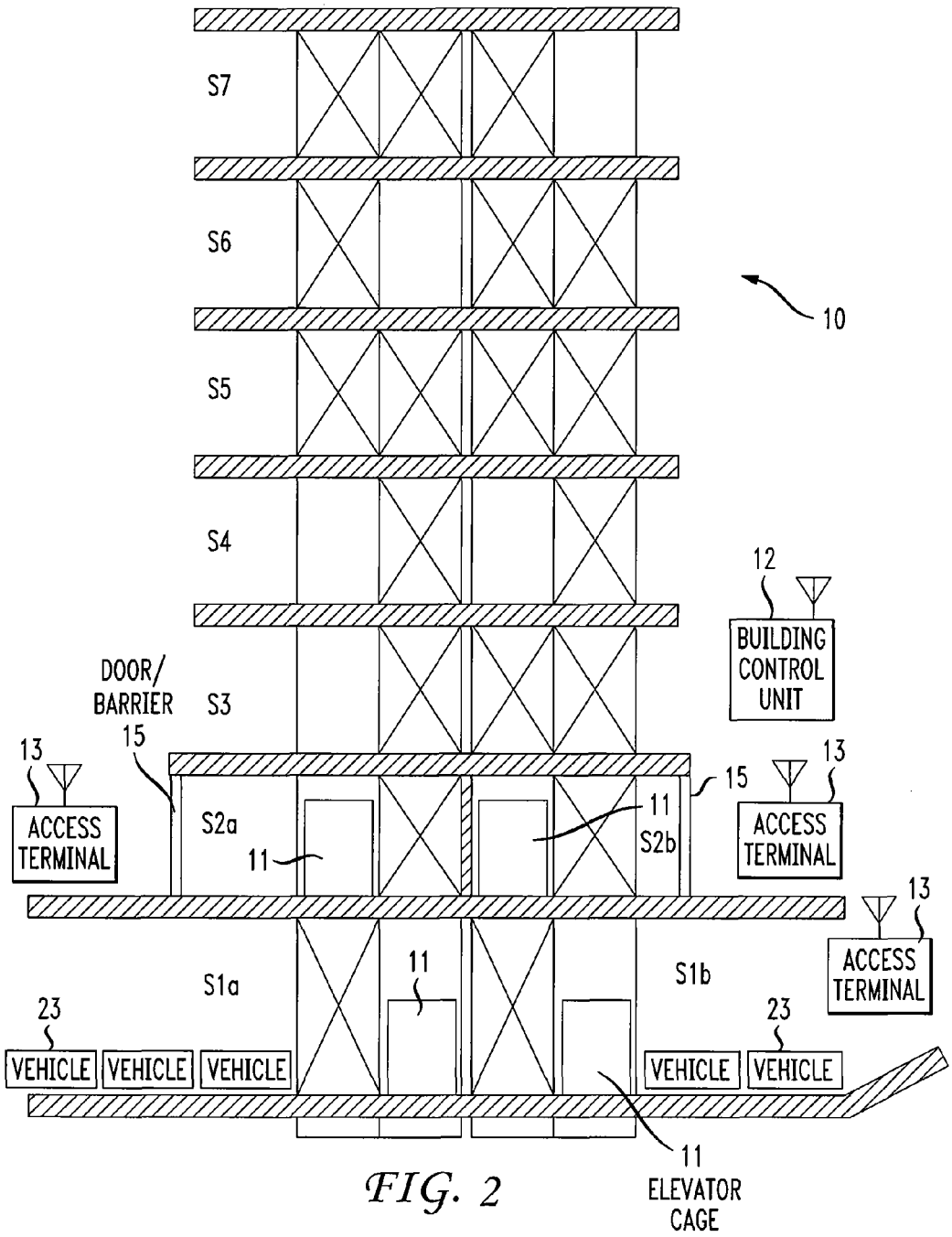
FIG. 2 shows a schematic illustration of an alternative elevator installation according to the present invention.

An alternative embodiment of an elevator installation 10 for use of the method according to the invention is illustrated in FIG. 2. The elevator installation 10 according to FIG. 2 has four elevator cages 11 arranged for the transportation of persons. The elevator installation 10 comprises four separate access stories S1*a*, S1*b*, S2*a* and S2*b*. Persons entering the elevator cage 11 at the access story S1*a* are transported to the destination story S6. Persons entering the elevator cage 11 at the access story S1*b* are transported to the destination story S7. Persons entering the elevator cage 11 at the second access story S2*a* are transported to the destination stories S3 and S4. Thereagainst, persons entering the elevator cage 11 on the other side of the second destination story S2*b* are transported only to the destination story S4. The respective access stories S1*a*, S1*b*, S2*a* and S2*b* are opened for access by way of doors or barriers 15 in each instance only after checking of the access authorisation at an access terminal 13. Destination stories S4, S5, S6 and S7 which cannot be moved to by individual elevator cages 11 are provided with a large "X". There are also destination stories S5 which are accessible by way of other elevator installations (not illustrated) or only by way of stairs. Destination stories S5 of that kind are, for example, reachable only by a manual elevator cage control, for example, in the case of use as a store or safety area without appreciable traffic of persons.

A further alternative embodiment of the elevator installation 10 is explained in FIG. 3 in conjunction with FIGS. 4*a* and 4*b*. The elevator installation 10 illustrated in FIG. 3 comprises several elevator shafts 18, 19, 20, 21 and 22. The elevator shaft 19 arranged in the middle serves for the distribution of persons within the building to so-termed destination or changeover stories S8*b*, S9*a* and S9*b*. Several lift cages 11, which are not illustrated, are moved in the elevator shaft 19. In that case use can be made of not only separate elevator cages 11, but also multiple elevator cages 16, 17, which are vertically divided into two separate part cages 16*a* and 16*b*, as is illustrated in FIG. 4*a*. It is also possible to horizontally divide a multiple cage 17 into two part cages 17*a* and 17*b*. In the case of use of a horizontally divided multiple cage 17 persons entering the part cage 17*b* from the first access story S1*b* are transported to the destination or changeover story S8*b*. Persons entering the part cage 17*a* at the access story S2*b* are conveyed to the destination or changeover story S9*b* separately from the persons from the access story 1*b*. It is possible to make one of the access stories S1*b* or S2*b* accessible for authorised persons (VIPs) who are then transported to a different destination story S8*b* or S9*b* separately from other persons and without coming into contact with the other persons, either in the elevator or at changeover stories. This is conceivable, for example, for transporting executives or board members.

In the case of a vertically separated multiple cage 16 according to FIG. 4*a* persons entering the part cage 16*a* at the access story S2*a* are transported to the destination or changeover story 9*a* and can travel there by an elevator cage 11 in the elevator shaft 21 to the region of their office. Persons boarding the part cage 16*b* from the opposite access story S2*b* are transported to a different destination and changeover story 9*b* and can travel by an elevator cage 11 in the other elevator shaft 22 to another office region of the building. Thus, for example, employees of a company A can be assigned a separate part cage 16*a* transporting exclusively employees of the company A, who in each instance are moved to the building region which is accessible from the elevator shaft 21 and with which the company A is associated. Employees of the company B are transported from the access story S2*b* separately to a building part which is opened up by the elevator shaft 22.

The co-ordination, which is required for effective utilisation of an elevator installation 10 according to FIG. 1, 2 or 3, of the visitor or person flows in a building is illustrated in FIGS. 5*a* and 5*b*. On entry into a building, an access authorisation is initially checked by an access terminal 13, in that an access code is input or transmitted. The access code can be stored on an ID card or an entry card. Depending on the respective access authorisation an access barrier 15, here in the form of a barrier 15*a*, 15*b*, opens as is illustrated in FIG. 5*a*. Depending on which access authorisation is present, for example, the lefthand barrier 15*a* opens for the company A or the righthand barrier 15*b* for the company B. The allocation of the access stories S1, S2 to the destination stories S6, S7 is indicated on an indicating device 14. The employees of the company A are guided to the first access story S1. Employees of the company B are guided to the second access story S2, so that the employees are assigned to the access stories S1, S2, from which they go to the fixedly allocated destination stories S6, S7, solely by way of the guidance to the access stories S1, S2 or parking levels.

Through the refinement according to the invention it is possible that the elevator cage 11 has to serve only a small number of different travel destinations, whereby a higher performance capability of the elevator installation 10 is achieved.

In the above-described examples of embodiment in each instance a fixed allocation of access stories S1, S2 to destination stories S4, SS, S6, S7 is illustrated. However, it is also possible in a simple embodiment that, for example, the elevator cage 11 travels from the access story S1 basically to the uneven-numbered destination stories S3, SS, S7 and the lift cage 11 at the second access story S2 travels to the even-numbered destination stories S4 and S6.

The idea according to the invention can also be analogously transferred to other applications. In the case of restaurants which extend over several stories the respective restaurant visitors can be assigned, already on driving into the parking building, to parking spaces, which correspond with their desired destination restaurant, for their vehicles 23. It is further possible to reach theaters or cinemas each time by way of an access story, for which the parking spaces correspond with the respectively allocated destination story, from which an elevator travels directly to a theatre or to a desired cinema. For example, the access code to an access story can be stored on the entrance ticket for a cinema visitor. On driving into a parking building the access code on the entry ticket is interrogated for the story in which the cinema in which the desired film is shown is located. There is indicated to the visitor on an indicating device 14 the corresponding parking level or access story S1, S2 from which an elevator cage 11 travels directly to the story with the cinema.

Through the refinement of the method and the arrangement, in accordance with the invention, for the transport of persons it is possible to enable a rapid journey to a specific travel destination, wherein only a small waiting time and a small destination time, i.e. the travel time to the destination, are necessary. Moreover, through the method according to the invention there is made possible travel with an elevator cage 11 in which authorised persons (VIPs) go as quickly as possible to their travel destination without other passengers or without non-VIP passengers in the same elevator cage 11.

The invention claimed is:

1. A method of using an elevator installation, the elevator installation comprising at least first and second elevator cages, the method comprising:

fixedly allocating at least one destination story for the first elevator cage to a first access story;

fixedly allocating at least one destination story for the second elevator cage to a second access story, the first and second access stories being different access stories; and assigning one or more passengers to the first access story to enter the first elevator cage, or to the second access story to enter the second elevator cage, according to respective destination stories of the one or more passengers.

2. The method according to claim 1, further comprising transporting at least one person who boarded the first elevator cage at the first access story to a first fixedly allocated destination story and transporting at least one person who boarded the second elevator cage at the second access story to a second fixedly allocated destination story.

3. The method according to claim 1, further comprising guiding persons with a common destination story to one or more common access stories.

4. The method according to claim 1, wherein the fixedly allocating includes fixedly allocating a first group of destination stories to the first access story and fixedly allocating a second group of destination stories to the second access story.

5. The method according to claim 4, wherein the first and second groups of destination stories comprise common destination stories.

6. The method according to claim 1 wherein the assigning is by a building control unit independently of an elevator control.

7. The method according to claim 6, further comprising checking an access authorization to an access story with the building control unit.

8. The method according to claim 7, wherein, after checking the access authorization to an access story, the destination story allocated to this access story is changed depending on a type of the access authorization.

9. The method according to claim 7, further comprising assigning one or more persons with a restricted access authorization to an access story from which only restricted, fixedly allocated destination stories can be reached.

10. An elevator installation comprising:

at least first and second elevator cages;

at least one control unit that assigns at least a first destination story to a first access story and at least a second destination story to a second access story, the first and second access stories being separate access stories, and that assigns one or more passengers to the first access story to enter the first elevator cage, or to the second access story to enter the second elevator cage, according to respective destination stories of the one or more passengers; and an indicating device for indicating an allocation of the first destination story and the second destination story to the first access story and the second access story, respectively.

11. The elevator installation according to claim 10 wherein the at least one control unit is a building control unit.

12. The elevator installation according to claim 11, further comprising at least one access terminal which is coupled with the building control unit and provided for checking an access authorization of at least one person.

13. The elevator installation according to claim 12, further comprising an access barrier provided for opening and closing one of the first access story and the second access story depending on the access authorization.

14. The elevator installation according to claim 10, wherein one of the first and second elevator cages comprises several part cages separate from one another.

15. An elevator installation building control unit that assigns an elevator passenger to one of a first access story and a second access story in a building for transportation to one of a first destination story and a second destination story in the building, wherein the assigning is based a passenger destination story, one of the first access story and the second access story being fixedly allocated to a respective one of the first destination story and the second destination story, the control unit coupled with an indicating device for indicating allocations of the first destination story and the second destination story.

16. The method of claim 1, wherein the first and second elevator cages are disposed in different elevator shafts.

17. The method of claim 1, the first access story being in a first level of a parking garage and the second access story being in a second level of a parking garage, the assigning being performed as the one or more passengers approach the elevator installation in one or more vehicles.

18. The elevator installation of claim 10, the indicating device comprising a display.

19. The elevator installation building control of claim 15, the indicating device comprising a display.

* * * * *